United States Patent [19]

Dunning et al.

[11] Patent Number: 4,538,745

[45] Date of Patent: Sep. 3, 1985

[54] TRIGGER SPRAYER

[75] Inventors: Walter B. Dunning, Pleasanton, Calif.; Robert L. Bundschuh, Miami Lakes, Fla.

[73] Assignee: The Clorox Company, Oakland, Calif.

[21] Appl. No.: 496,330

[22] Filed: May 19, 1983

[51] Int. Cl.[3] ..... B67B 5/00

[52] U.S. Cl. ..... 222/153; 222/321; 239/357

[58] Field of Search ..... 222/153, 321, 383, 384, 222/81, 83, 88, 83.5, 541, 80, 542; 239/359, 357, 356, 525, 526; 417/560, 559, 562

[56] References Cited

U.S. PATENT DOCUMENTS

| | | | |
|---|---|---|---|
| 3,102,489 | 9/1963 | Corsette et al. | 103/42 |
| 3,131,646 | 5/1964 | Farrott | 103/188 |
| 3,282,472 | 11/1966 | Roder | 222/321 |
| 3,441,177 | 4/1969 | Treharne, Jr. | 222/83 |
| 3,527,551 | 9/1970 | Kutik et al. | 417/560 |
| 3,877,616 | 4/1975 | Stevens | 222/321 |
| 3,913,841 | 10/1975 | Tada | 239/321 |
| 3,927,834 | 12/1975 | Tada | 239/359 |
| 4,046,495 | 9/1977 | Grimm, Jr. | 417/268 |
| 4,137,930 | 2/1979 | Scholle | 222/83 |
| 4,159,067 | 6/1979 | Akers | 222/153 |
| 4,167,941 | 9/1979 | Capra et al. | 222/321 |
| 4,228,931 | 10/1980 | Ruscitti et al. | 222/321 |
| 4,330,071 | 5/1982 | Ohlson | 222/207 |
| 4,347,953 | 9/1982 | Bauer | 222/207 |

*Primary Examiner*—H. Grant Skaggs
*Assistant Examiner*—Kenneth Noland
*Attorney, Agent, or Firm*—Stephen M. Westbrook; Joel J. Hayashida

[57] ABSTRACT

A trigger sprayer for generating a spray of liquid from a container comprising five parts including a housing having a tubular piston with an open ended liquid flow passageway therein; a tubular actuator member slidably received over the piston, having a trigger rigidly extending therefrom and defining a chamber therein with a spray orifice at one end; a rod disposed in the actuator member and including a frustoconical skirt forming a valve in the chamber across the spray orifice; an inlet valve carried by the tubular piston and including an extended valve portion slidably seated on the rod, and a biasing spring disposed between the valves. The inlet valve may include a shipping seal member formed integrally therewith and disposed on the inlet passage to seal it until the sprayer is ready for use whereupon the rod will displace or break the seal upon actuation of the sprayer.

14 Claims, 7 Drawing Figures

TRIGGER SPRAYER

TECHNICAL FIELD

This invention relates to the field of manually operated trigger sprayers for dispensing liquids from bottles and similar containers, and more particularly to means for providing valve means therefor, and means for providing sealing thereof during shipment and storage until ready for use.

BACKGROUND OF THE INVENTION

Manually operated trigger sprayers for dispensing liquids from a bottle or a similar container are well known and are in wide use in connection with the use of home cleaning products. Such dispensers provide a convenient means of dispensing, applying and using such home cleaning products. A wide number of such trigger sprayers are known in a prior art. However, the prior art trigger sprayers do not avoid some of the disadvantages of such devices, which include structural complexity which significantly adds to the cost of the product, and leakage during shipping and storage prior to use.

It is therefore an object of the present invention to provide a manual trigger sprayer that has a minimum number of parts yet performs as well as existing sprayers, and is inexpensive to manufacture and simple to assemble.

It is also an object of the present invention to provide a means of sealing such a trigger sprayer, or any trigger sprayer, against leakage of liquid from a container to which it is affixed during shipment or storage.

It is a further object of the present invention to provide for such a shipping seal in a trigger sprayer that is inexpensive to manufacture and assemble and does not significantly add to the number of parts in the sprayer.

A further object of the present invention is to provide such a shipping seal in a trigger sprayer which can be easily disposed of by the ultimate user without any special or difficult removal operations being required.

It is also an object of the present invention to provide a vent valve for controllably venting air to the interior of a container coupled to the sprayer.

SUMMARY OF THE INVENTION

The trigger sprayer of the present invention includes a housing and an actuator reciprocally slidable within the housing, wherein the housing and actuator provide a pump chamber, inlet and outlet passages in said housing and actuator for communicating fluid to and from the pump chamber, and inlet and outlet valves for controlling flow of fluid in the inlet and outlet passages. The valves include an axial rod member having a frustoconical skirt providing one of the valves and a distal end providing a slidable valve seat for the other of the valves. A flexible tubular member includes a frustoconical portion arranged to cooperate with the distal end of the rod to provide said other valve.

The present invention also provides a shipping seal disposed within a passage leading to the sprayer pump chamber for sealing thereof and which is arranged to be displaced from said sealing location upon actuation of the sprayer by the rod member, to allow fluid to flow through the passage. The seal is provided as an integral portion of the flexible tubular member.

The present invention also provides a vent passage valve for control of air flow through the sprayer into a container to which it is coupled. The vent passage valve is provided by another portion of the flexible tubular member.

DESCRIPTION OF THE PREFERRED EMBODIMENT

Figure 1:
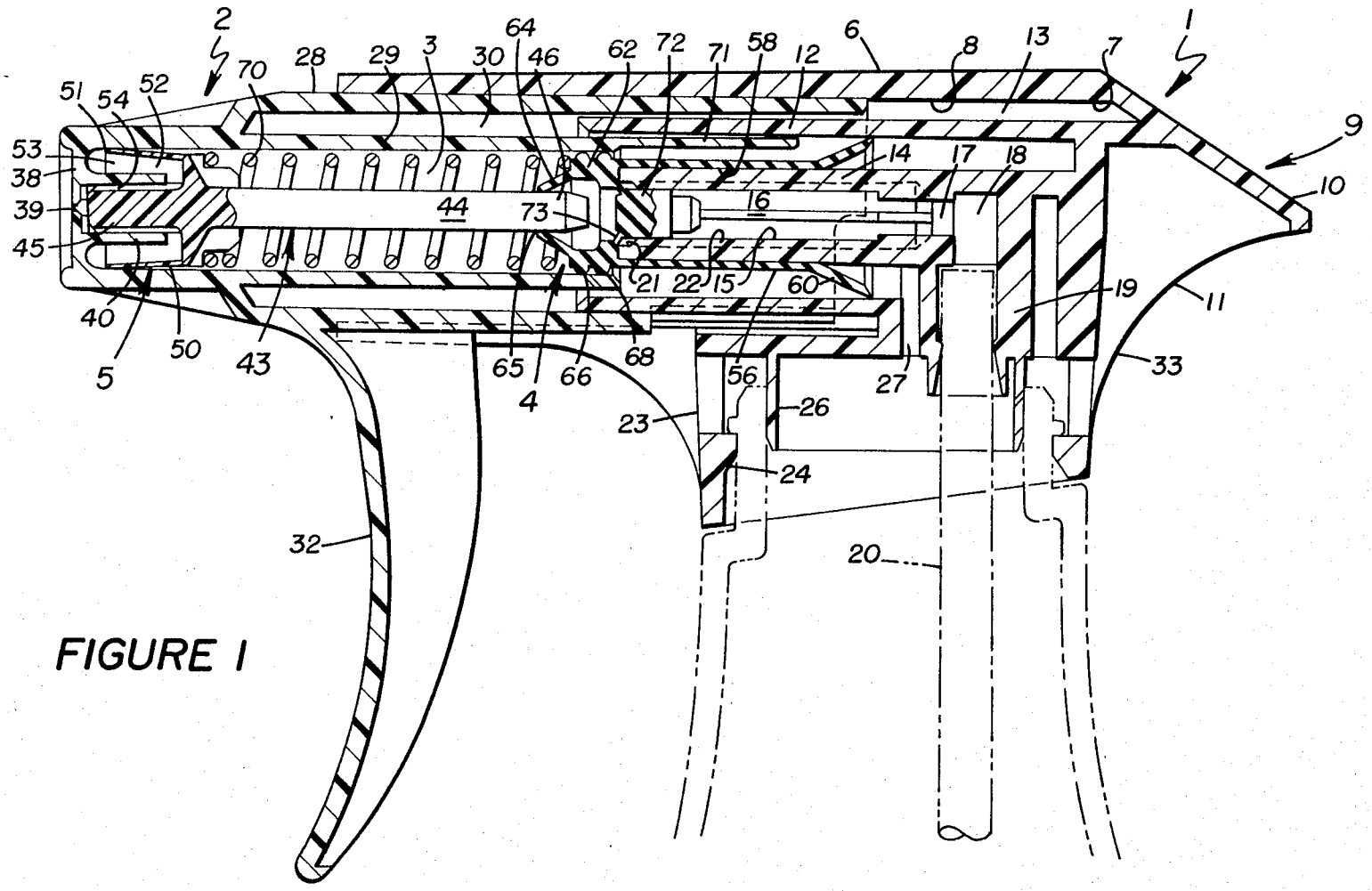
FIG. 1 is a sectional view of a trigger sprayer embodying the present invention.
Figure 2:
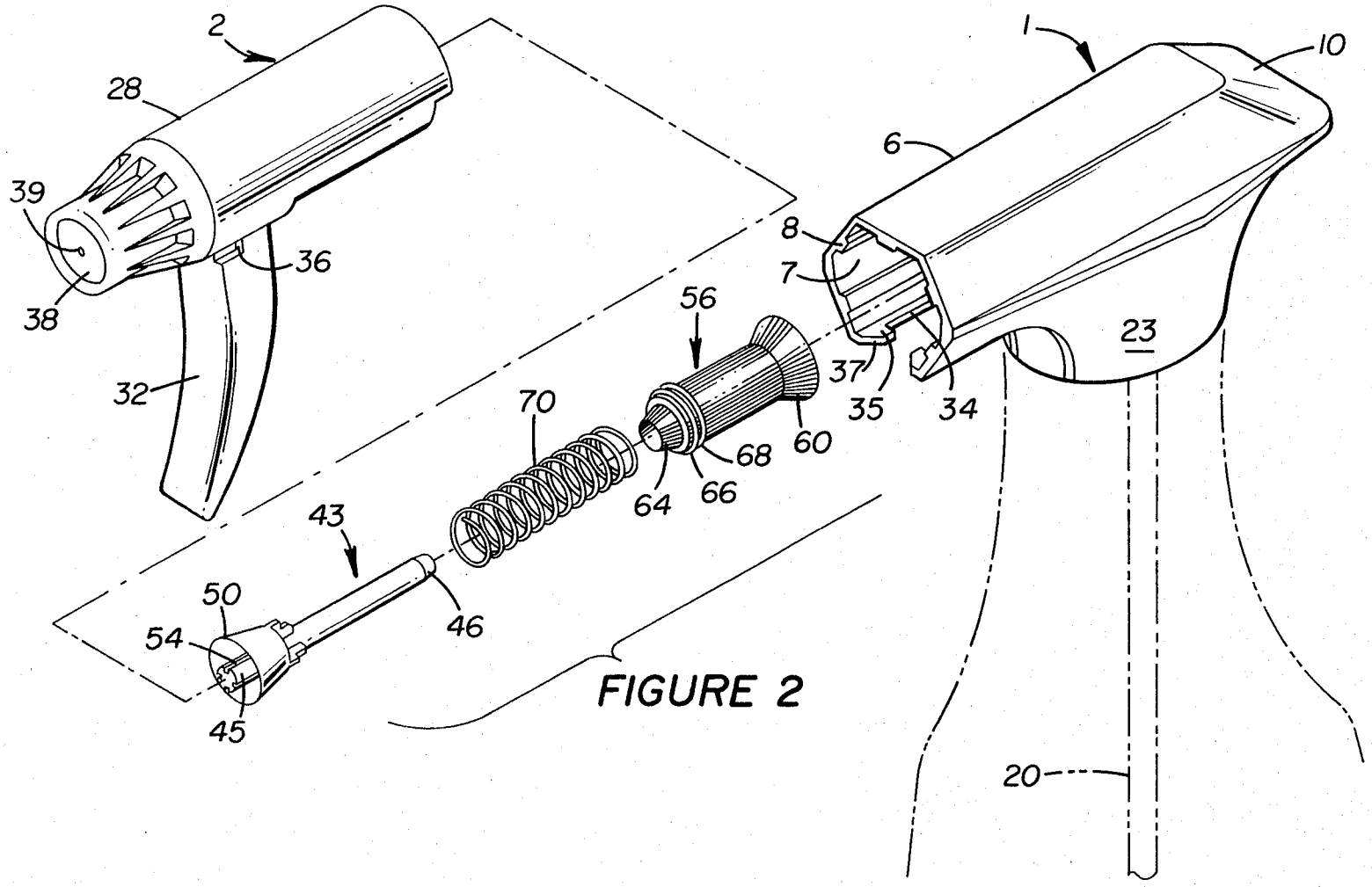
FIG. 2 is an exploded perspective view of a trigger sprayer of the present invention.
Figure 4:
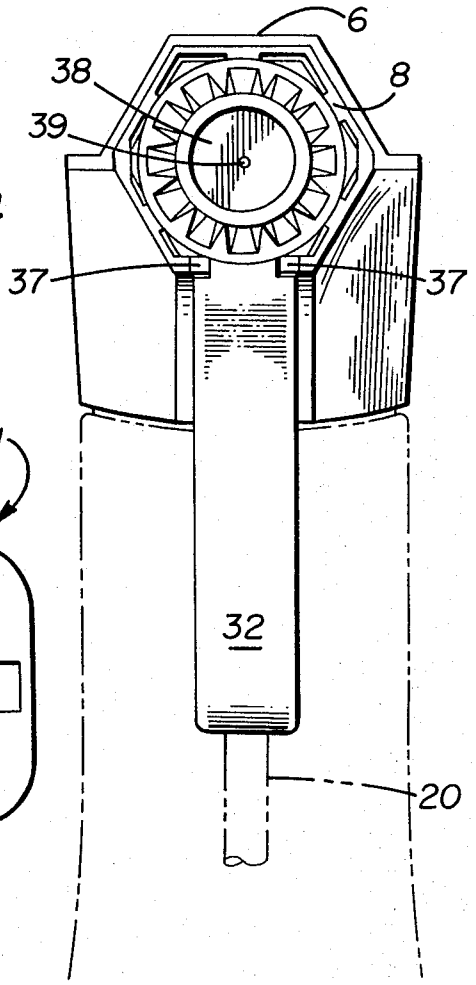
FIG. 4 is an end view of the trigger sprayer of the present invention.
Figure 3:
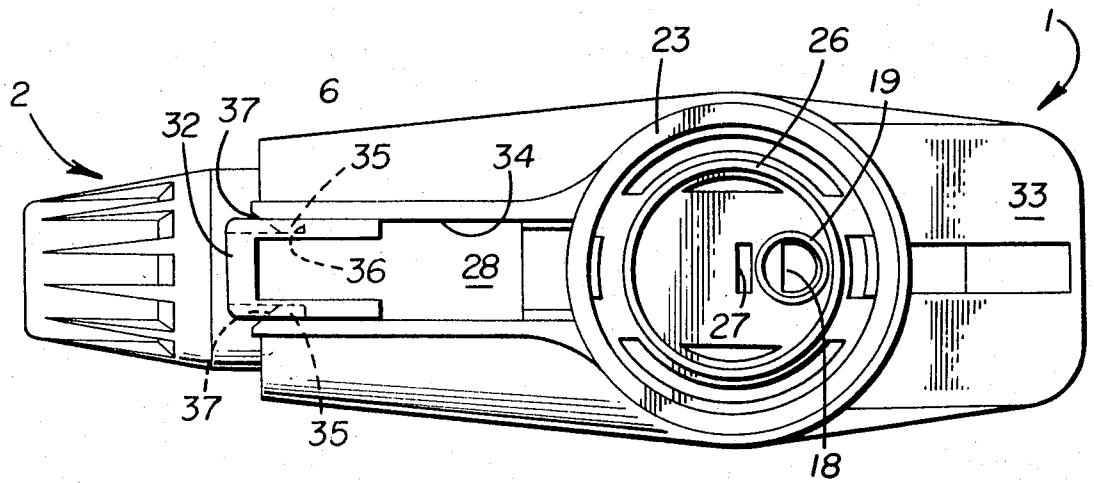
FIG. 3 is a bottom view of the trigger sprayer of the present invention.

Referring to FIG. 1, a trigger sprayer constructed in accordance with the present invention comprises a housing 1, and an actuating member 2, telescopically slidable thereon and defining a pump chamber 3. An inlet valve, indicated generally at 4, and an outlet valve, indicated generally at 5, control communication of fluid within the pump chamber.

The housing 1 includes an outer hexagonal housing member 6 having an inner surface 7 with slides 8 provided thereon. A rear end 9 of the housing is closed by tapered walls 10 and 11. Projecting from said walls is a housing cylinder 12, disposed concentrically within the housing member, and defining therewith an annular space 13 therebetween. Disposed concentrically within cylinder 12 is a tubular piston 14 having a bore 15 defining an inlet passageway 16. The inlet passageway has a first end 17 in fluid communication with a bore 18 provided in a tubular cylinder 19 arranged to receive a dip tube 20 therein. Passageway 16 has a second, distal end 21 which opens into pump chamber 3. Longitudinal ribs 22 are provided in the inner walls of passageway 16 inwardly of distal end 21.

The housing also includes a depending cylindrical coupling member 23 which depends from housing member 6 and includes means such as lugs 24 for coupling the housing to a plastic bottle finish or the like, such as over a snap ring. However it will be evident that the coupled means may comprise other coupling arrangements such as threads.

Disposed coaxially within coupling member 23 and depending from cylinder 12 is a cylindrical sealing member 26 which is arranged to engage the inner surface of a bottle finish coupled to the housing in sealing relationship therewith.

A venting passage 27 extends from within sealing member 25 through cylinder 12 so that the annular space within cylinder 12 is in fluid communication with the interior of a container coupled to the housing by coupling member 23.

The actuating member 2 comprises an outer cylindrical member 28 adapted for telescopic sliding within outer housing member 6 on slides 8, and a concentrically spaced inner cylinder 29, slidably disposed within cylinder 12, and defining with outer cylinder 8 an annular space 30.

The actuating member has a manually engagable trigger 32 extending downwardly therefrom, and the rear wall 9 of the housing has a rest surface 33 whereby the trigger and rest cooperate to provide manual gripping and actuating means. The trigger depends through a slot 34 provided in the bottom facet of housing member 6 for reciprocation therein. The slot has stops 35 provided at the outer end which are adapted to engage stop surfaces 36 on the trigger to retain the trigger within the slot and the actuator within the housing. The front surfaces 37 of stops 35 are cammed so that the actuator may be pushed into the housing member, and retained by the trigger which may be merely snapped within the resilient slot during assembly of the actuator in the housing.

The actuating member 2 has a closed end wall 38 with a centrally located spray orifice 39 therein and a cylindrical projection 40 extending inwardly therefrom and surrounding the orifice.

The actuating member 2 is slidably received on the housing so that the outer cylindrical member 12 on the housing fits into the annular space 30 in the actuating member, and the inner cylindrical member 29 of the actuating member is slidably received within the inner surface of the outer cylindrical member 12 on the housing.

Outlet valve 4 comprises an elongated member 43 in the form of a rod 44 having a first end 45 disposed in cylinder 40, and a distal end 46 arranged to extend within tubular piston 14 upon actuation of the sprayer.

Near the first end of the rod is a frustoconical skirt 50 extending outwardly from the rod and terminating in an outer annular edge 51 in seated engagement with the inner surface of cylindrical member 29. Skirt 50 will flex under pump chamber pressure to unseat, and thus forms an outlet valve between pump chamber 3 and orifice 39. An exit passageway 52 is defined by annular space 53 within the skirt, and a plurality of longitudinal recesses 54 provided in the first end and outer surface of rod 44 between said end and cylinder 40. The longitudinal recesses 54 thus form fluid passage means for communication of fluid from the pump chamber 3 to spray orifice 39. Rod 44, including frustoconical skirt 50 is formed from a single piece of plastic material for simple and inexpensive construction.

The first end of the rod is engaged in a force-fit relationship in the interior surface of the cylindrical projection 40 extending from end wall 34 of actuating member 2 for ease of assembly.

The inlet valve 4 comprises a flexible tubular member 56 having an internal diameter bore 58 slidably received in a force-fit, relationship on the distal end of tubular piston 14. At a first end of the tubular member 56 is an outwardly diverging frustoconical portion 60 defining a vent valve which is in slidable sealing engagement with the inner surface of housing cylinder 12.

The second end of the tubular valve member 56 includes a reduced internal diameter portion 62 which extends beyond the distal end of the tubular piston and terminates in an inwardly converging frustoconical valve portion 64 terminating in an edge 65 which is slidably seated on the outer surface of rod 44. Valve portion 64 and rod 44 thus cooperate to provide an inlet valve for controlling flow of fluid through passage 16.

A pair of spaced outwardly extending annular ribs 66 and 68 are provided on the outer surface of the cylindrical valve member 56, at the second end thereof, and are in slidable sealing engagement with the inner surface of inner cylindrical member 29 on the actuating member.

Disposed coaxially around rod 44 between the outer end of tubular valve member 56 and frustoconical skirt 50 and in abutment therewith is a helical spring 70 which biases the actuating member away from the housing against stops 35.

Cylinder 29 includes a finger 71 which is arranged to unseat vent valve 60 upon retraction of the actuator, whereupon venting is provided by air which flows between the housing member 6 and cylinder 12 around outer cylindrical member 28 on the actuater as well as the space between the outer cylindrical 12 and cylinder member 29, past unseated valve member 60, and then through the venting passage 27. It has been found that if the frustoconical member 60 is sufficiently flexible that portion 60 will flex upon a drop in pressure in the bottle to unseat from cylinder 12 to allow air flow through the venting passage 22 due to pressure difference between the interior of the bottle and its surroundings, the finger 71 may be eliminated.

Figure 5:
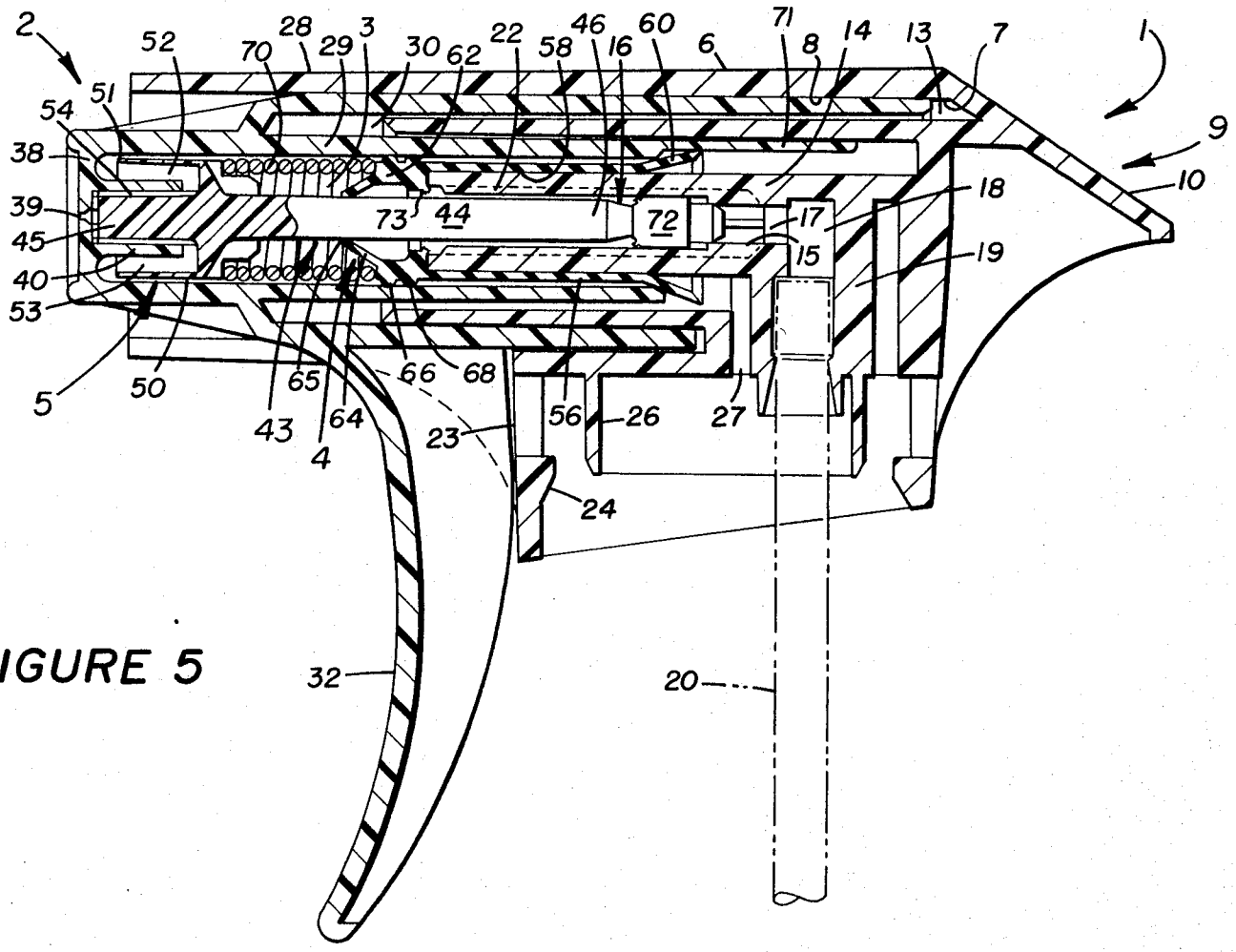
FIG. 5 is a sectional view of the trigger sprayer of the present invention after actuation thereof.

The sprayer of the present invention includes a shipping seal for preventing liquid from leaking or flowing from the bottle or sprayer prior to consumer use. The shipping seal comprises a cylindrical plug 72 which is connected to valve member 56 by a frangible web 73 and forms an integral part of the valve member. The plug is disposed in passageway 16 on ribs 22. The plug and web form a seal for the passageway 16, and thus the sprayer. The frangible web and plug remain intact until the actuating member is first moved inwardly towards the housing, as shown in FIG. 5, at which time the blunt end 46 of rod 44 will push the plug 72 inward of passageway 16 on ribs 22, rupturing web 73. The plug thus remains inwardly of and spaced from the end of bore 15 in passageway 16 as shown in FIG. 5. Ribs 22 provide fluid communication between the ribs so that liquid can flow through passage 16 past the plug and the ruptured web. Thus the ribs provide a bypass means for communicating fluid through the passageway and around the displaced plug. It will be apparent that such bypass means could also comprise channels, grooves or other bypass passages.

When the actuator is manually retracted into the housing fluid pressure in pump chamber 3 will increase due to the decreased volume of the pump chamber. The increased fluid pressure in the pump chamber will cause skirt 50 to flex inwardly, unseating edge 51 from the inner surface of the actuator, allowing pump chamber fluid to exit through passage 53 and orifice 39, where liquids will be expelled in a spray. The increased pump chamber pressure will also help maintain inlet valve portion 64 seated against the rod during actuator retraction, sealing the pump chamber from the inlet passage. At the completion of the manual retraction stoke, the actuator will return to its initial extended position against stops 35 by spring 70, decreasing the pressure in pump chamber 3, thereby allowing the inherent spring force of skirt 50 to return edge 51 to it original position in cylinder 29, thus closing the outlet valve 5 against the actuator cylinder 29.

Vent pressure in the bottle will then force liquid through the dip tube and inlet passage, pushing the inlet valve open and into the pump chamber, allowing the pump chamber to refill with liquid from the bottle.

Figure 6:
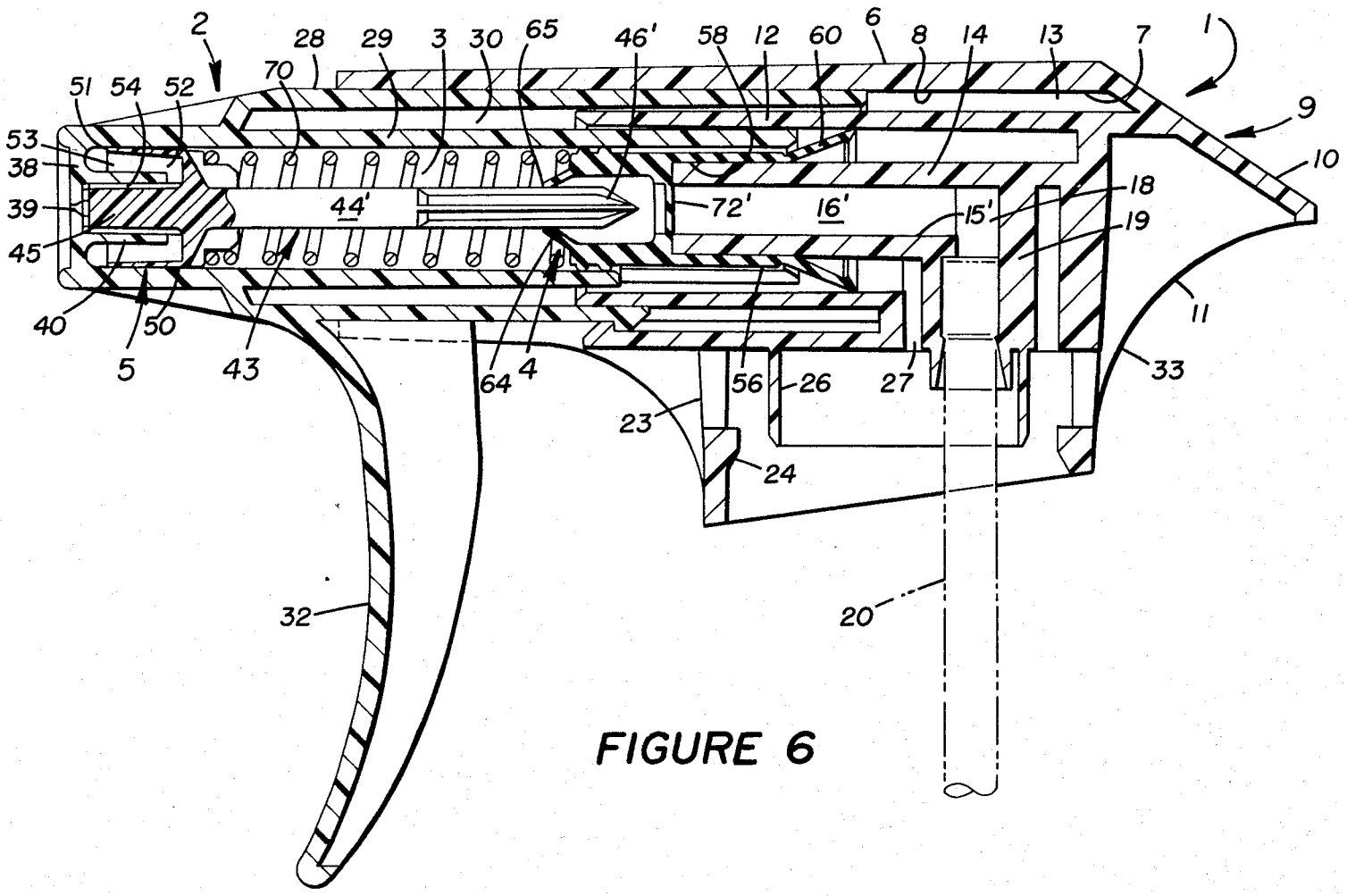
FIG. 6 is a sectional view of an alternative embodiment of the present invention.
Figure 7:
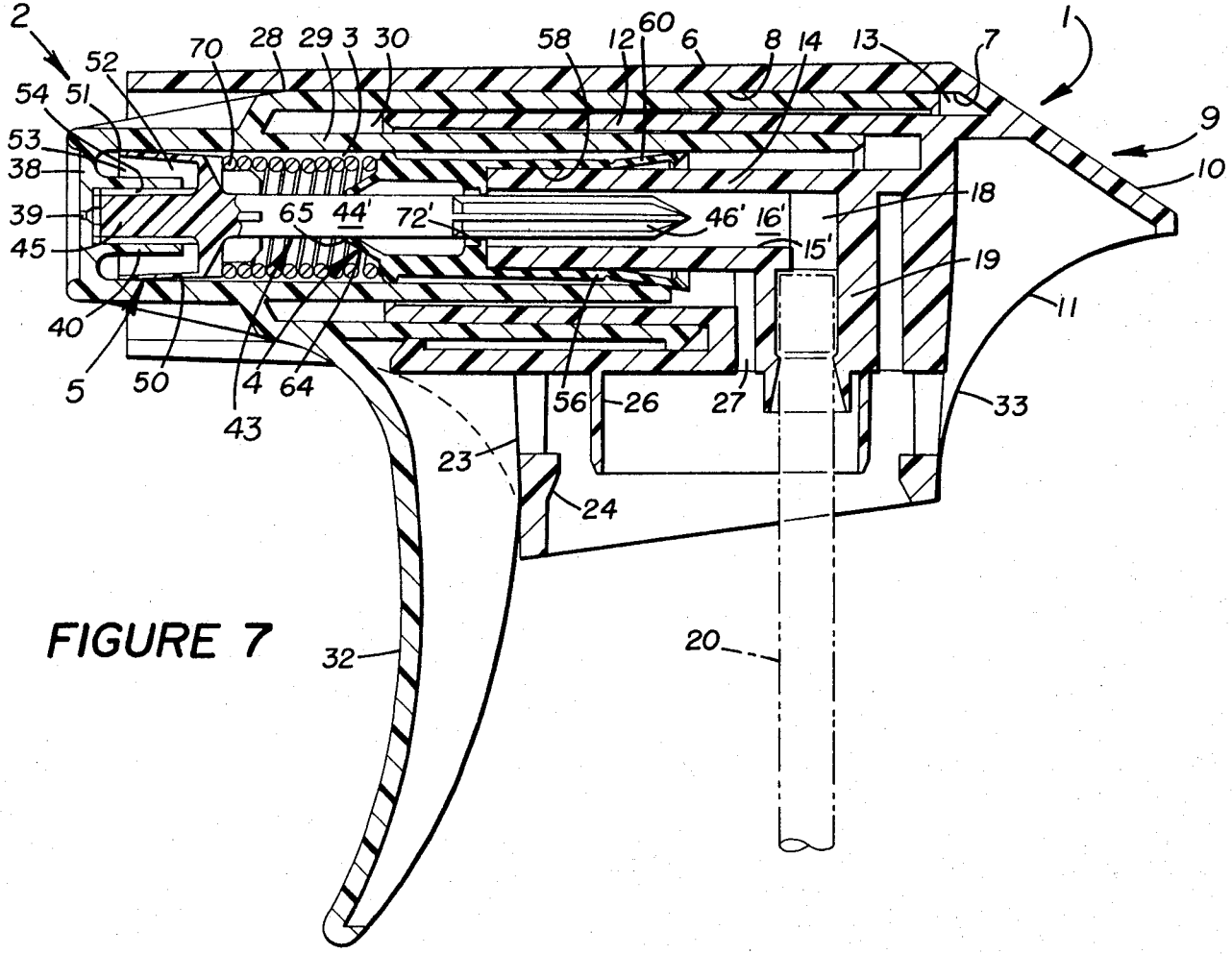
FIG. 7 is a sectional view of the alternative embodiment of the present invention after use.

An alternate embodiment of the present invention is shown in FIGS. 6 and 7. In these embodiments rod 44' has a distal end 46' provided with a sword-like configuration, and shipping seal 72' comprises a thin membrane disposed within the internal diameter of valve member 56 over inlet passage 16' defined by a smooth bore 15'.

Upon initial actuation of the actuating member, whereby it is manually retracted into the housing, sword 46' will pierce shipping seal 72' to open inlet fluid passage 16' for the flow of fluid from the dip tube through passageway 16' and past valve 4 into the pump chamber.

While various advantageous embodiments have been chosen to illustrate the present invention, it will be understood by those skilled in the art that various changes and modifications can be made therein without departing from the scope of the invention as defined in the appended claims.

What is claimed is:

1. A trigger sprayer for manually dispensing fluid from a container comprising a housing and an actuator reciprocally slidable within the housing, said housing and said actuator including means for providing a pump chamber therein, inlet passageway for connecting fluid from a container to the pump chamber provided in said housing, outlet passageway for allowing exit of fluid from the pump chamber, provided in said actuator, inlet valve means for controlling flow of fluid from the inlet passage to the pump chamber, outlet valve means for controlling fluid flow through said exit passage, shipping seal means for sealing said inlet passageway, and unsealing means for unsealing the shipping seal means upon reciprocation of the actuator into the housing.

2. The invention of claim 1 wherein the shipping seal means comprises a plug disposed within said inlet passageway, and said inlet passageway comprises a conduit including a bypass channel formed in a portion thereof, and said unsealing means comprises a rod disposed within the pump chamber and having a distal end aligned with said seal plug whereby upon manual sliding of the actuator into the housing of the rod will displace the seal plug from its seat to the bypass portion of the inlet passageway, allowing fluid to flow through the passageway and channel.

3. The invention of claim 2 wherein the seal plug is disposed in the inlet passageway and said rod is disposed on the actuator in axial alignment with the inlet passageway.

4. The invention of claim 3 wherein said inlet passageway comprises an open ended tubular piston disposed in said housing and said inlet valve comprises a flexible tubular member having a first portion disposed on said tubular piston and a second portion extending forward of the inlet passageway and including an annular valve portion seated in sliding relationship on the rod, and said seal plug is disposed within the tubular member by a frangible web, and is an inherent portion of the tubular member.

5. The invention of claim 4 wherein said sprayer further comprises vent channel means comprising an annular space between said tubular piston and said housing and said tubular valve member includes a vent valve portion.

6. The invention of claim 5 wherein said vent valve portion comprises a flexible conical skirt provided on the first portion of the tubular member arranged to close said annular vent passage, said skirt being sufficiently flexible to flex upon drop of pressure in a container coupled to the sprayer to allow air passage into the container.

7. The invention of claim 5 wherein said vent valve portion comprises a flexible conical skirt provided on the first portion of the tubular member arranged to close said annular vent passage, and further comprising a finger disposed on said actuator and arranged to unseat the vent valve upon sliding of the actuator into the housing.

8. The invention of claim 1 wherein the seal means comprises a thin walled seal member arranged to seal said inlet passageway, and said unsealing means comprises a sword arranged to rupture said seal member upon manual sliding of the actuator into the housing.

9. In a trigger sprayer for generating a spray of liquid from a container having a liquid therein, including:

a housing having a tubular piston including means defining an inlet passageway disposed therein, means for coupling a dip tube to said housing in liquid flow communication with said inlet passageway, means on said housing for coupling a container in an air-tight manner to said housing with the dip tube extending into the container, vent means, located in said housing, for providing an air vent to the interior of the container, a tubular actuator member slidably received over said tubular piston, having an elongated trigger extending rigidly therefrom and having a closed outer end with an outlet passageway therein, said tubular actuator member with said tubular piston defining a chamber therein communicating with said first inlet and outlet passageway, inlet valve means, located against said inlet passageway member over said inlet passageway and in said chamber for preventing air and liquid from flowing into said inlet passageway from said chamber but allowing liquid to flow from said inlet passageway to said chamber, outlet valve means, coupled to said tubular actuator member in said chamber between said inlet valve means and said outlet passage, for preventing air from entering said chamber via said outlet passage when said tubular member is moved away from said housing but allowing liquid in said chamber to be expelled from said chamber via said outlet passage when said tubular actuator member is moved towards said housing, and means for biasing said tubular member away from said housing;

the improvement comprising seal means for sealing said inlet passageway during shipping and storage prior to use while the tubular actuator is normally biased in an extended position with respect to the tubular piston, and unsealing means for disabling said sealing means to provide for fluid flow through the inlet passageway upon manual actuation of the sprayer to slide said tubular actuator member toward said tubular piston.

10. A trigger sprayer according to claim 9, wherein the inlet passageway includes bypass channels provided in a portion of the wall thereof, and said seal means comprises a plug disposed in the inlet passage increased by the channels, said unsealing means comprising a rod arranged to push said plug into the bypass portion of the inlet passage upon manual actuation of the sprayer, and said inboard valve means further comprises a resilient annular portion in slidable sealing engagement with the surface of said rod member.

11. A trigger sprayer according to claim 10 wherein said outlet valve means comprises, a frustoconical skirt member extending outwardly from one end of said rod member.

12. A trigger sprayer for generating a spray of liquid from a container having a liquid therein, the combination comprising:

a single-piece molded plastic housing including an open ended tubular piston with an inlet passageway therein, means for coupling a dip tube to said housing in liquid flow communication with said inlet passageway, means for coupling a container in an air-tight manner to said housing with the dip tube extending into the container, and vent means for providing an air vent to the interior of the container;

a single-piece molded plastic actuator member including an elongated trigger extending therefrom, a closed outer end with a spray orifice therein, and an annular wall around the orifice defining a socket, said tubular actuator member slidably received over said tubular piston, said tubular actuator member defining a pump chamber therein communicating with said inlet passage in said piston and said spray orifice in said tubular actuator member;

a combined outlet valve and inlet valve seat member comprising a rod member having a first end disposed in said socket, said rod extending into the pump chamber, and having a resilient frustoconical skirt on said rod engaging said tubular actuator member, an inlet valve formed of resilient material and including an annular member having a first portion disposed on said tubular piston, and a second portion extending beyond the end of the tubular portion and terminating in a valve portion seated slidably on the rod, and spring means, engaging said housing and tubular member, for biasing said tubular member away from said housing wherein said spray orifice in said tubular member is spaced from said piston.

13. The trigger sprayer of claim 12 further comprising stop means for limiting the extent of movement of said tubular member away from said housing under the influence of said spring means, said stop means being arranged to engage the trigger to limit extension of the actuator from the housing.

14. The invention of claim 13 wherein the housing includes an open ended slot terminating at its open end in said stop means, and said trigger is disposed in said slot, said stop means including front surfaces whereby the trigger can be snapped past the stop means and into the slot upon assembly of the actuator with the housing.

* * * * *